US010334993B1

(12) United States Patent
Nastasi

(10) Patent No.: US 10,334,993 B1
(45) Date of Patent: Jul. 2, 2019

(54) SHOWER STALL FLOOR AND METHOD OF CONSTRUCTION

(71) Applicant: Joseph Nastasi, Commack, NY (US)

(72) Inventor: Joseph Nastasi, Commack, NY (US)

( * ) Notice: Subject to any disclaimer, the term of this patent is extended or adjusted under 35 U.S.C. 154(b) by 0 days.

(21) Appl. No.: 15/660,648

(22) Filed: Jul. 26, 2017

(51) Int. Cl.
*A47K 3/40* (2006.01)
*E03F 5/04* (2006.01)
*E04F 15/02* (2006.01)

(52) U.S. Cl.
CPC ..... *A47K 3/40* (2013.01); *E04F 15/02188* (2013.01); *E03F 5/0408* (2013.01)

(58) Field of Classification Search
CPC ..... A47K 3/40; E04F 15/02188; E03F 5/0408
USPC ..... 4/612, 613, 614
See application file for complete search history.

(56) References Cited

U.S. PATENT DOCUMENTS 2,059,614 A * 11/1936 Schooler ..... A47K 3/283 4/614
4,771,488 A * 9/1988 Markham ..... A47K 1/04 4/631
4,894,272 A * 1/1990 Aisley ..... B29C 39/026 428/119
5,816,005 A * 10/1998 Han ..... A47K 3/008 52/391
5,845,347 A * 12/1998 Young ..... A47K 3/008 4/613
5,913,777 A * 6/1999 Gerber ..... A47K 3/40 4/596
6,442,905 B1 * 9/2002 Weinstein ..... A47B 77/022 4/631
9,332,883 B1 * 5/2016 Angelella ..... A47K 3/008
2001/0052148 A1 * 12/2001 Hasenkopf ..... A47K 3/40 4/613
2006/0213006 A1 * 9/2006 Rush, Jr. ..... A47K 3/40 4/613
2008/0222891 A1 * 9/2008 Cook ..... A47K 3/40 29/890.141
2010/0320130 A1 * 12/2010 Meyers ..... E03F 5/04 210/164
2014/0121301 A1 * 5/2014 Schibur ..... A47K 1/04 523/458

FOREIGN PATENT DOCUMENTS

JP 05017982 A * 1/1993

* cited by examiner

*Primary Examiner* — Erin Deery
(74) *Attorney, Agent, or Firm* — Edwin D. Schindler

(57) ABSTRACT

A method of manufacturing a customized shower pan or floor includes the steps in which the desired shower stall area is measured to determine an outer periphery with regard to the existing drain in situ and then a shower pan mold is constructed with both an outer and a drain periphery. In a first embodiment, a resin/filler is poured partway in to the mold and then pre-cut tiles are placed in a desired manner on top of the resin while it cures. In a second embodiment, a single slab is poured with a resin/filler mixed with crushed or powdered stone, metal, or the like. The set shower pan is then placed and the drain periphery is grouted to the existing drain and plumbed.

6 Claims, 7 Drawing Sheets

SHOWER STALL FLOOR AND METHOD OF CONSTRUCTION

BACKGROUND OF THE INVENTION

Technical Field of Invention

The present invention relates generally to shower stall construction and, more specifically, to a shower stall base that is initially a resin/filler mix poured into a preformed customized mold which is then provided with upper surface tile facings during the curing process. More particularly, it relates to a shower stall base that may be formed to a custom size and shape and then may be surfaced with a wide variety of designs and tile shapes.

Description of the Prior Art

There are other methods for the construction of shower stall bases which provide for ease of design, installation, and customization. While these shower base stalls may be suitable for the purposes for which they where designed, they would not be as suitable for the purposes of the present invention as heretofore described. It is thus desirable to provide a method for creating a customized shower base stall that can be easily placed into a desired shower location without the need of hand grouting. It is further desirable to have a method for creating a shower base stall where the only elaborate step necessary is for the drain to be plumbed in.

SUMMARY OF THE INVENTION

A primary object of the present invention is to provide a shower stall floor that is preformed and can be put in place without a tile worker on-site.

Another object of the present invention is to provide a shower stall floor that after installation is simple to clean and maintain.

Yet another object of the present invention is to provide a shower stall floor that is prefabricated of a non-porous material.

Still yet another object of the present invention is to provide a shower stall floor that may be provided with varying degrees of non-slip surfaces.

Another object of the present invention is to provide a shower stall floor where the size and shape of the floor is easily customized.

Yet another object of the present invention is to provide a shower stall floor where the installation procedure is simply placing the prefabricated base and then plumbing the drain.

Additional objects of the present invention will appear as the description proceeds.

The foregoing and related objects are accomplished by the present invention that provides a method for fabricating and installing a shower pan to an existing drain at a desired shower stall location, the method including the steps of measuring the shower stall location to determine shower pan edge dimensions and locating the existing drain in relation to the shower pan edge dimensions to determine a drain periphery, forming a shower pan mold between the shower pan edges and said the periphery, providing, and then placing, a plurality of tiles within the shower pan mold to form a desired shower pan surface, providing, and then pouring, a resin/filler into the shower pan mold over the plurality of tiles, curing the resin/filler, removing the cured resin/filler and the plurality of tiles from the shower pan mold, so that the desired shower pan surface is uppermost, placing the desired shower pan surface, cured resin/filler and the placed plurality of tiles into the desired shower stall location, so that the drain periphery is aligned with the existing drain, fixing the drain periphery to the existing drain, and plumbing the existing drain to the shower pan mold.

The present invention overcomes the shortcomings of the prior art by providing an easily customized shower stall base that is prefabricated to fit the location, may be smooth surfaced or variously tiled to fit the decor and simply needs to be placed and then the drain plumbed in.

Other objects and features of the present invention will become apparent when considered in combination with the accompanying drawing figures, which illustrate certain preferred embodiment of the present invention. It should, however, be noted that the accompanying drawing figures are intended to illustrate only select preferred embodiments of the claimed invention and are not intended as a means for defining the limits and scope of the invention.

DESCRIPTION OF THE REFERENCED NUMERALS

Turning now descriptively to the drawings, in which similar reference characters denote similar elements throughout the several views, the figures illustrate the use of the present invention. With regard to the reference numerals used, the following numbering is used throughout the various drawing figures:

10 present invention
12 shower stall
14 shower pan
16 pan mold edge
18 shower pan face surface
20 resin/filler
22 drain
24 drain periphery
26 tile
28 slab resin/filler
30 shower pan step/curb
32 concrete pour
34 concrete pour edge

BRIEF DESCRIPTION OF THE DRAWING FIGURES

In the drawing figures, wherein similar features are denoted with similar reference numerals throughout the several views.

DETAILED DESCRIPTION OF THE DRAWING FIGURES AND PREFERRED EMBODIMENTS

Figure 1:
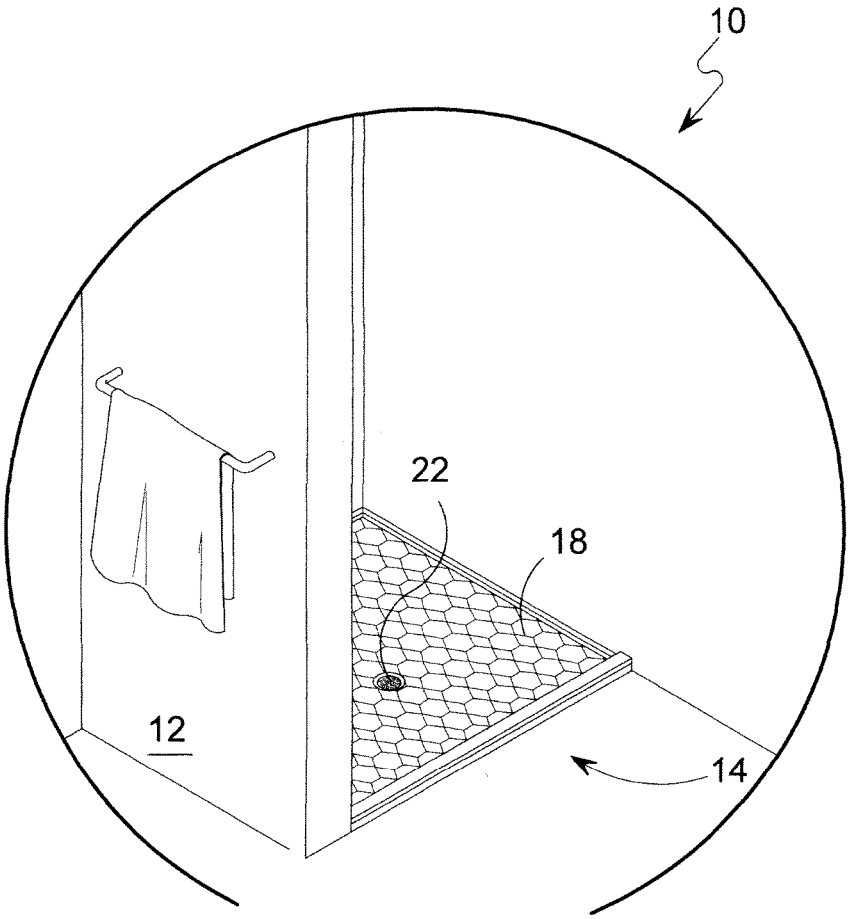
FIG. 1 is a perspective overview of the shower pan of the present invention in place.

An overview of the present invention is seen in FIG. 1. It is generally indicated at 10 and includes the shower pan 14, a shower pan facing (top) surface 18, a drain 22, and a pan mold edge 16. This prefabricated unit 10 is placed within a shower stall 12 and then simply plumbed in as will be discussed further below.

Figure 2:
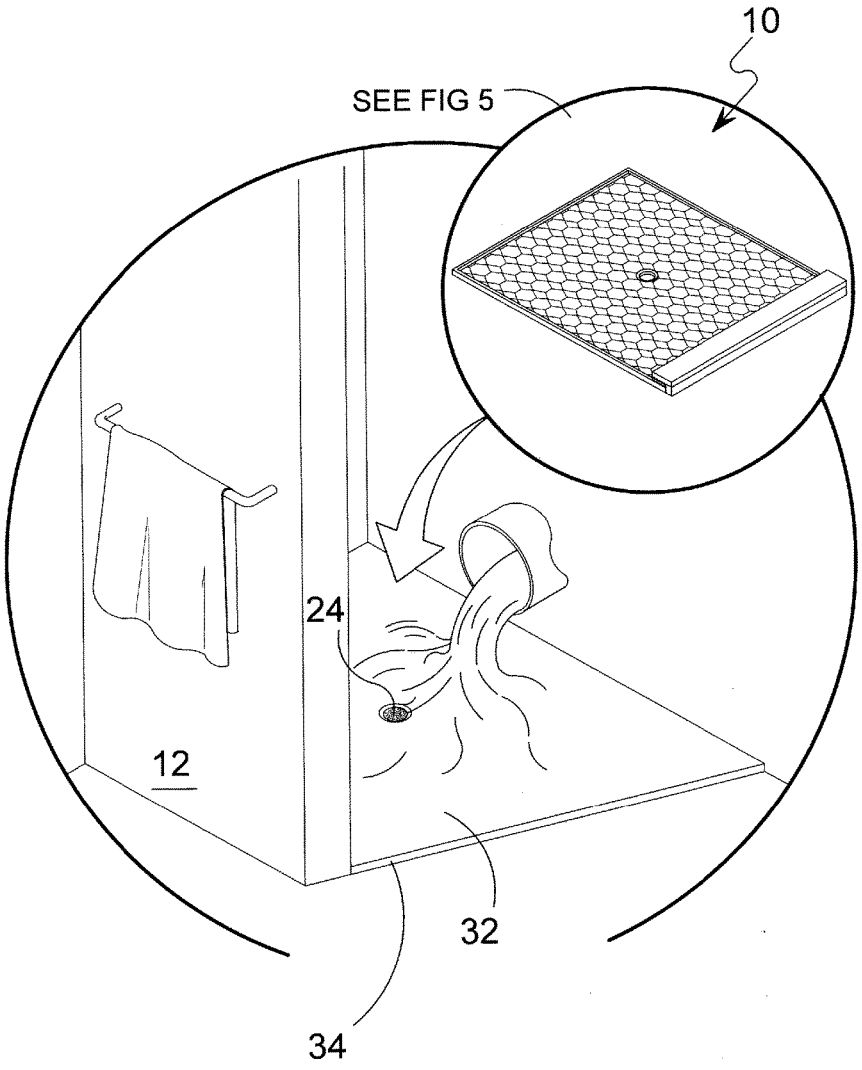
FIG. 2 is a perspective view of a resin and filler pouring step in the manufacture of the present invention.
Figure 4:
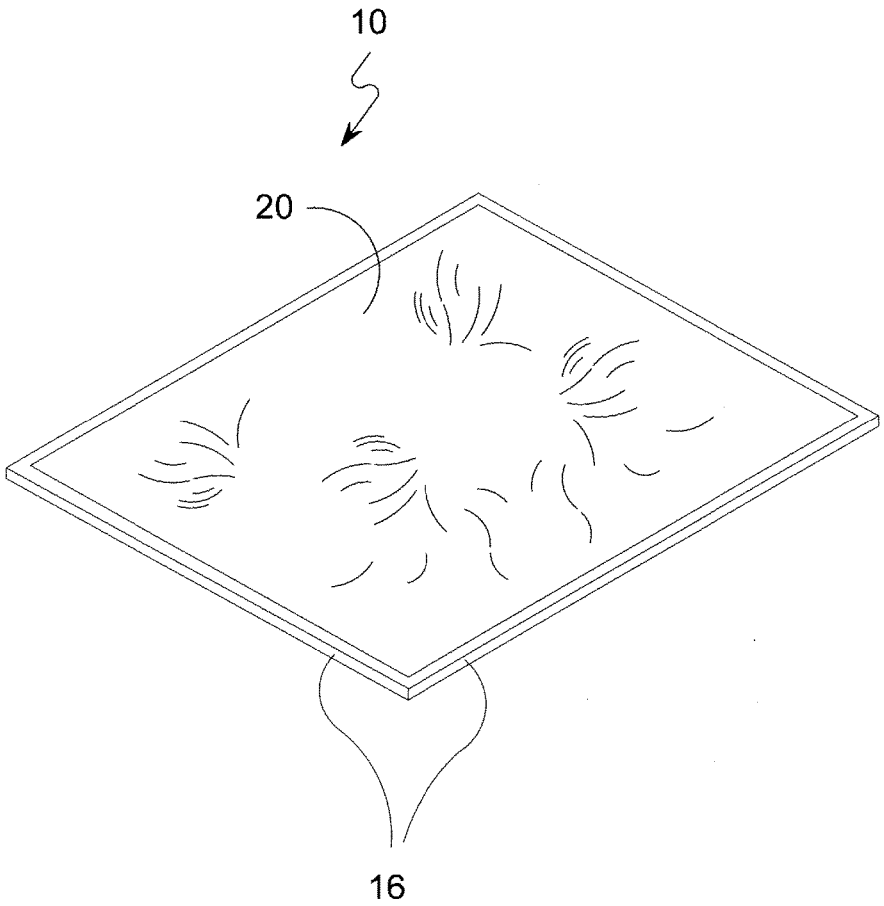
FIG. 4 is a perspective view of the curing step of the present invention with the shower pan in the mold before it is flipped over for placement.

Turning to FIG. 2, the initial concrete pouring step on-site is shown. The concrete 32 is poured into the base of the shower stall 12 as seen between the drain periphery 24 and the concrete pour edges 34. Also seen in FIG. 2 is the completed present invention 10 ready to be installed in place. In the factory (off-site or in a different location on-site) the mold for the shower pan 14 is prepared. Pan mold edges 16 are cut and fitted together to create a mold to receive the resin/filler matrix 20 as seen in FIG. 4. The pan mold edges 16 could be made from a variety of materials such as cut stone, various grades of plastics, metal such as stainless steel, or the like. Tiles 26 (as discussed below) are placed "face down" in the prepared mold to form the resulting shower pan face surface 18 and limestone powder is poured into the crevasses between the tiles 26. Then the resin 20 is poured. It is contemplated that the resin/filler 20 would be a material such as STYPOL® which is a sprayable (or pourable) resin. STYPOL® 040-4950-4953 is the fastest cure in colder temperatures with -4968 being the slowest cure for higher temps. (STYPOL® is a registered trademark for synthetic resin compositions; the trademark being owned by CCP Composites, a Delaware partnership, P.O. Box 419389, Kansas City, Mo. 64141-6389.) The cure time needs to be kept in mind when the facing or tiling part of the manufacture process is reached, if a large number of individual tiles are going to be placed within/on the matrix. According to manufacturer's literature, STYPOL®-6095, 6097, 6098 could be used for a marble matrix formation with 25% STYPOL® and 75% calcium carbonate (with any necessary catalyst, depending on circumstances). This would provide a non-tiled shower pan surface. In any case, note that the resin/filler 20 is sprayed, poured, or otherwise placed within the pan mold edges 16 and the drain periphery 24. It should also be emphasized at this point that the sizes and shapes of the pan mold edges 16 are determined by the location into which the present invention 10 is to be installed. The sides of the shower stall are measured at the base and an entrance step, if desired, is accounted for. The location of the drain pipe that the shower will be plumbed to is noted and then the mold is constructed and the resin/filler is sprayed or poured within it as shown.

Figure 3:
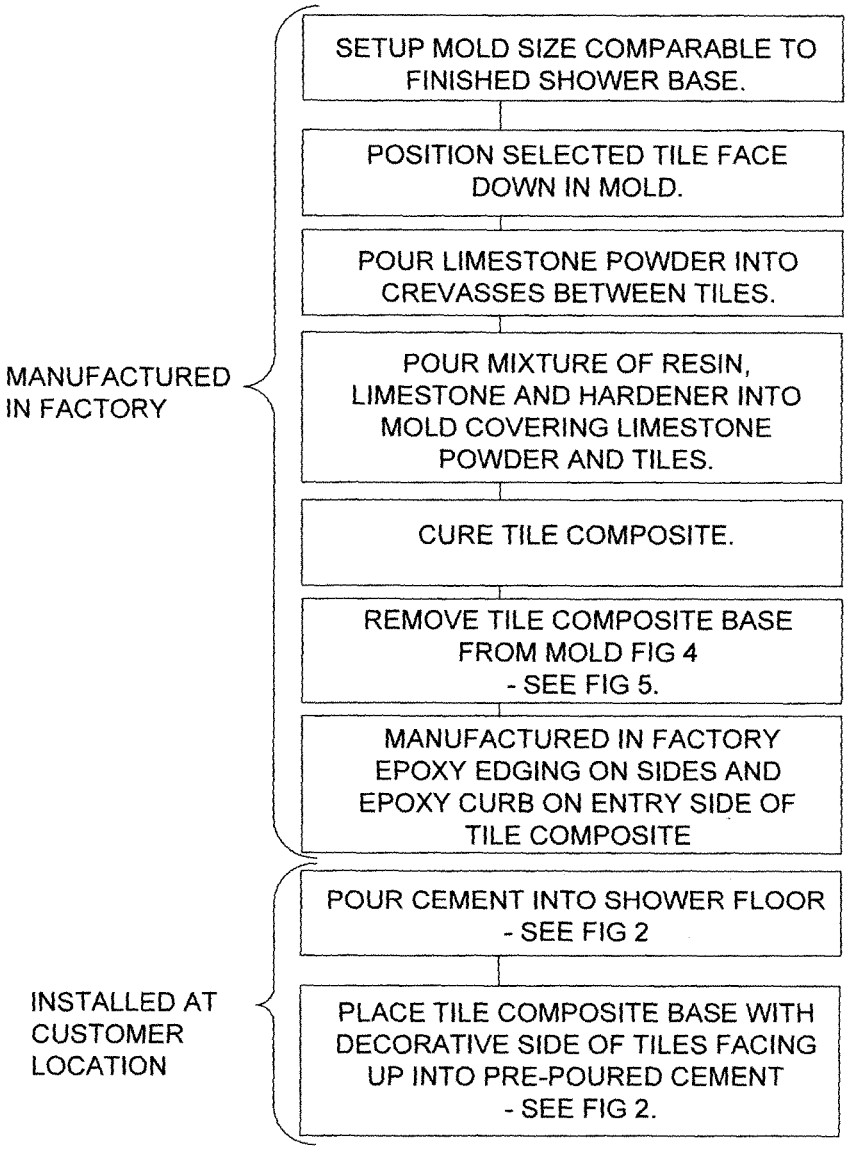
FIG. 3 is a block diagram/flowchart showing the steps in performing the present invention.

FIG. 3 is a flowchart or block diagram of the steps of the present invention that shows both the on-site and off-site procedures.

FIG. 4, as mentioned above, shows the curing step of the present invention. The times needed for curing can be predicted and/or influenced by composition of the resin/filler and temperatures. Tile designs can be pre-planned and pre-cut to make quick work of it while the resin/filler 20 is curing. This eliminates the need for an on-site tile layer when the shower pan is being installed. Additionally, this method eliminates the need for the tile layers to travel to various sites (or locations on-site) in that all the tile laying is done at a central location, either at the building site or at a shop.

Figure 5:
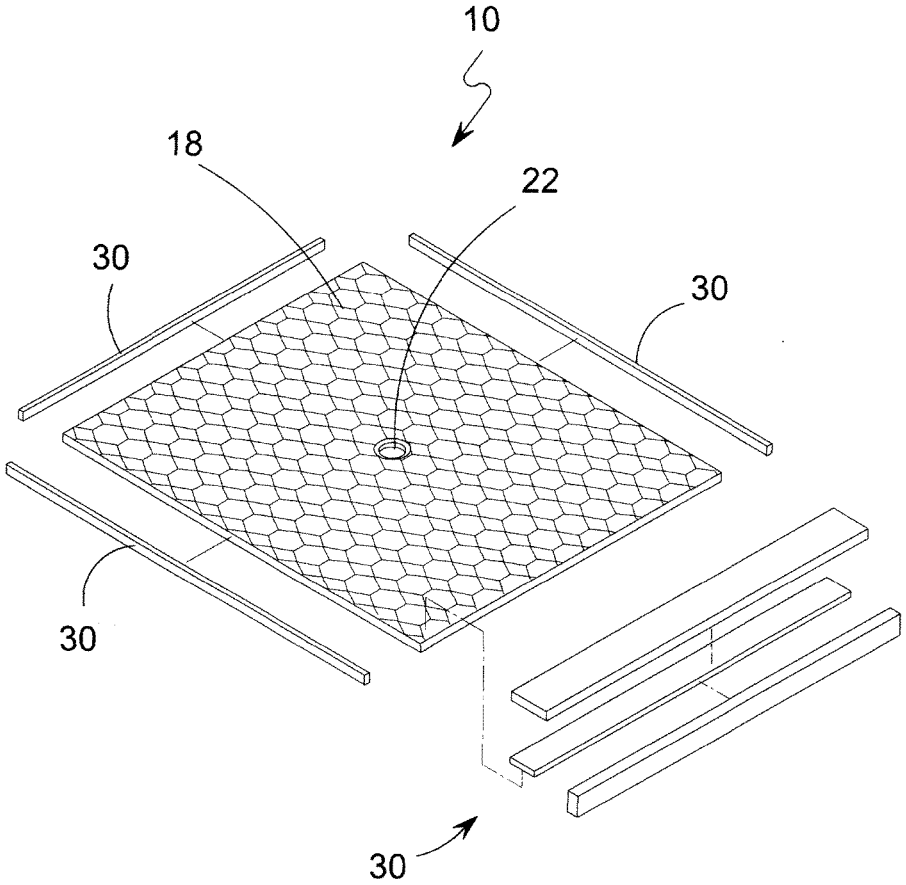
FIG. 5 is a perspective view of the present invention turned over, removed from the mold edges, and with the curb and step ready for installation.

In FIG. 5, the curing step is over and the shower pan 14 has been turned over or "flipped" so that the shower pan face surface 18 is uppermost. The pan mold edges 16 have been removed and a curb and a step 30 are ready to be assembled and installed.

Figure 6:
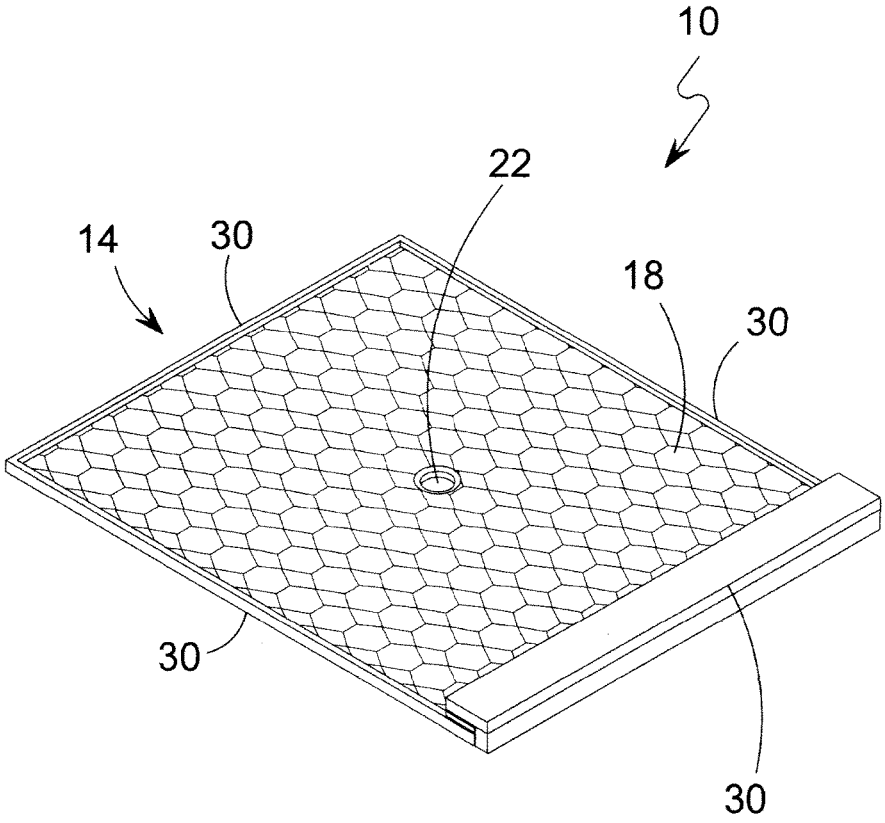
FIG. 6 is a perspective view of the present invention ready for installation in the desired location and with the curb and step incorporated; and, FIG. 7 is an overview of various tile designs that could be incorporated in the present invention.

In FIG. 6, the curb and step 30 is installed and the shower pan 14 is ready for placement in the predetermined location within a shower stall 12.

Figure 7:
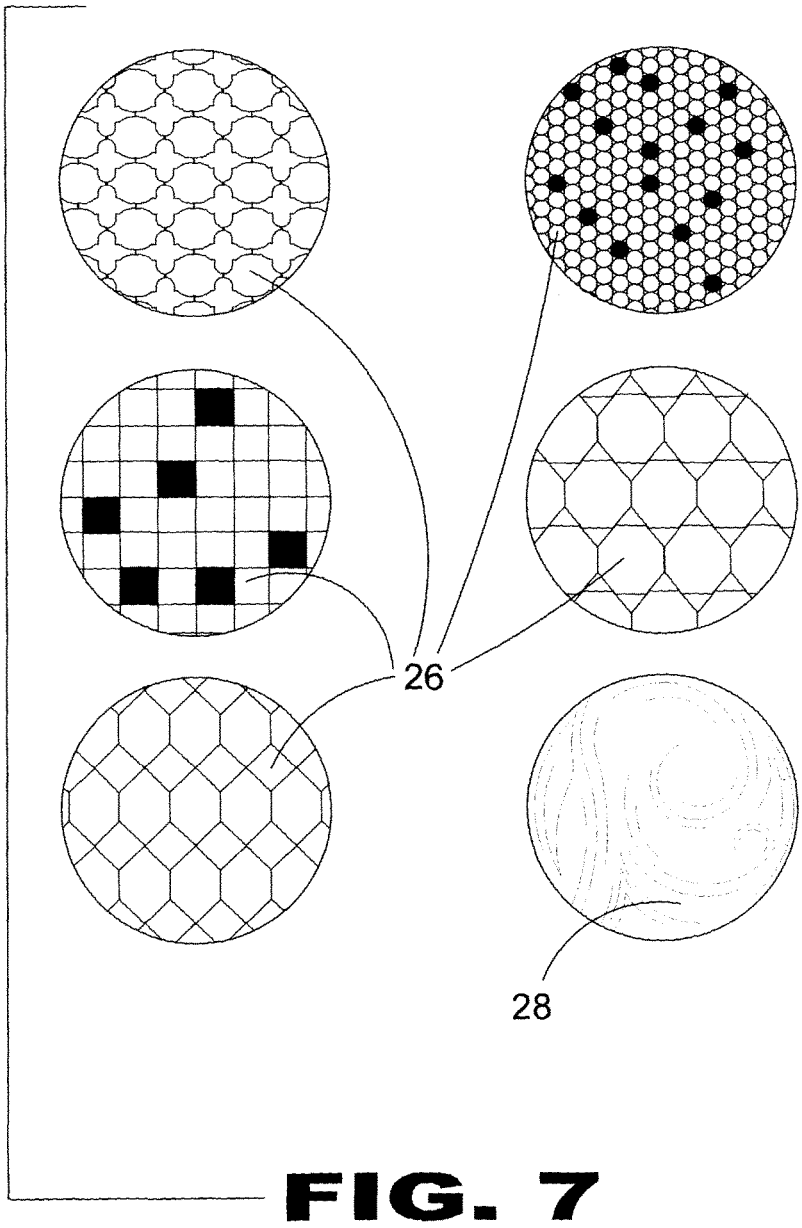

Lastly, FIG. 7 shows several examples of the variety of tile patterns 26 that can be used with the present invention.

While only several embodiments of the present invention have been shown and described, it will be obvious to those skilled in the art that many modifications may be made to the present invention without departing from the spirit and scope thereof.

What is claimed is:

1. A method for fabricating and installing a shower pan to an existing drain at a shower stall location comprising the steps of:

measuring said shower stall location to determine shower stall edge dimensions;

locating an existing drain in relation to said shower stall edge dimensions to determine a drain periphery;

forming a shower pan mold in accordance with said shower stall edge dimensions and said drain periphery;

providing and then placing a plurality of tiles within said shower pan mold to form a shower pan surface;

providing and then pouring a resin/filler into said shower pan mold over said plurality of tiles;

curing said resin/filler;

removing said cured resin/filler and said plurality of tiles from said shower pan mold such that said shower pan surface is uppermost;

placing said shower pan surface with said cured resin/filler, into said shower stall location such that said drain periphery is aligned with said existing drain;

fixing said drain periphery to said existing drain; and, plumbing said existing drain to said shower pan surface.

2. The method for fabricating and installing a shower pan according to claim 1, wherein said plurality of tiles provided and placed within said shower pan mold are pre-cut to fit said shower pan mold.

3. The method for fabricating and installing a shower pan according to claim 1, wherein said shower pan mold is made of a non-porous material.

4. The method for fabricating and installing a shower pan according to claim 1, wherein said shower pan mold is made of a polyurethane plastic.

5. The method for fabricating and installing a shower pan according to claim 1, wherein said shower pan mold is made of a metal.

6. The method for fabricating and installing a shower pan according to claim 1, wherein said shower pan mold is at least partially made of cut stone.

* * * * *